US006746545B2

(12) United States Patent
Tamura et al.

(10) Patent No.: US 6,746,545 B2
(45) Date of Patent: Jun. 8, 2004

(54) PREPARATION OF RARE EARTH PERMANENT MAGNETS

(75) Inventors: Kazuo Tamura, Takefu (JP); Masanobu Shimao, Takefu (JP); Ryuji Hamada, Takefu (JP); Takehisa Minowa, Takefu (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/866,853

(22) Filed: May 30, 2001

(65) Prior Publication Data

US 2002/0033205 A1 Mar. 21, 2002

(30) Foreign Application Priority Data

May 31, 2000 (JP) ..... 2000-162301

(51) Int. Cl.[7] ..... H01F 1/03

(52) U.S. Cl. ..... 148/122; 148/101; 148/102; 148/103; 419/12; 419/19; 419/20; 419/29; 419/33

(58) Field of Search ..... 148/101, 102, 148/103, 122; 419/12, 19, 20, 29, 33

(56) References Cited

U.S. PATENT DOCUMENTS 4,684,406 A * 8/1987 Matsuura et al. ..... 75/244
4,826,546 A * 5/1989 Yamamoto et al. ..... 148/102
4,888,068 A * 12/1989 Tokunaga et al. ..... 148/104
4,898,625 A * 2/1990 Otsuka et al. ..... 148/101
4,902,357 A * 2/1990 Imaizumi ..... 148/101
4,992,234 A * 2/1991 Ohashi et al. ..... 419/23
5,405,455 A * 4/1995 Kusunoki et al. ..... 148/103
5,595,608 A * 1/1997 Takebuchi et al. ..... 148/103

FOREIGN PATENT DOCUMENTS

EP 0 289 599 A1 11/1988
EP 0 994 493 A2 4/2000
JP 61-195964 * 8/1986
JP 11-150930 6/1999

OTHER PUBLICATIONS

Abstract of Japanese 11–150930.

* cited by examiner

*Primary Examiner*—John P. Sheehan
(74) *Attorney, Agent, or Firm*—Miller, White, Zelano, Branigan, P.C.

(57) ABSTRACT

An R—Fe—B permanent magnet wherein R is Nd or a combination of Nd with a rare earth element is prepared by casting an R—Fe—B alloy, crushing the alloy in an oxygen-free atmosphere of argon, nitrogen or vacuum, effecting comminution, compaction, sintering, aging, and cutting and/or polishing the magnet to give a finished surface. The magnet is then heat treated in an argon, nitrogen or low-pressure vacuum atmosphere having a limited oxygen partial pressure, obtaining a highly oil resistant sintered permanent magnet having corrosion resistance and hydrogen barrier property even in a high pressure hot environment of refrigerant and/or lubricant as encountered in compressors.

12 Claims, 2 Drawing Sheets

PREPARATION OF RARE EARTH PERMANENT MAGNETS

This invention relates to a method for preparing rare earth permanent magnets to be exposed to refrigerants and/or lubricants for an extended period of time, and especially useful in high efficiency motors.

BACKGROUND OF THE INVENTION

Owing to their magnetic properties and economy, rare earth permanent magnets are utilized in many areas of electric and electronic equipment. The production of rare earth permanent magnets is rapidly increasing in these years. As compared with rare earth cobalt magnets, rare earth permanent magnets are advantageous in that neodymium as the predominant element is present in more plenty than samarium, the raw material cost is low because of the relatively low content of cobalt, and their magnetic properties substantially surpass those of rare earth cobalt magnets. The rare earth permanent magnets now find use not only in small-size magnetic circuits where rare earth cobalt magnets have been used, but also in areas where hard ferrite and electromagnets have been used. Also in the field of motors for use in compressors in air conditioners and refrigerators, transition from prior art induction motors and synchronous motors using ferrite magnets to DC brushless motors using rare earth magnets is in progress for the purpose of increasing energy efficiency for reducing the power consumption.

R—Fe—B permanent magnets have the drawback that they are readily oxidized in humid air within a short time since they contain rare earth elements and iron as main components. When R—Fe—B magnets are incorporated in magnetic circuits, oxidative corrosion can reduce the output of magnetic circuits and generate rust with which the surrounding equipment is contaminated. Therefore, rare earth magnets are generally surface treated prior to use. The surface treatment on rare earth magnets includes electroplating, electroless plating, aluminum-ion plating, and various coating techniques.

To find use in air conditioner compressor motors and industrial motors to operate in refrigerant, lubricant or mixed systems, the rare earth permanent magnets are required to be corrosion resistant under high pressure and high temperature conditions in the refrigerant and refrigerating machine oil mixed system.

For example, JP-A 11-150930 discloses the use of non-surface-treated rare earth magnet as the core of the rotor in a refrigerating compressor. However, the combination of HFC refrigerant with an ether or ester base refrigerating machine oil can detract from the magnetic properties of the magnet incorporated in the system during a long term of operation at high temperature.

Also in automotive motors to be operated while kept immersed in lubricants, corrosion reaction will take place between the magnet and the lubricant, detracting from magnetic properties.

Then in these applications, it must be contemplated to carry out any of the above-mentioned surface treatments. However, the Al-ion plating technique is expensive and industrially inexpedient. Coating is unacceptable because of reaction with solvents and oil. The plating technique has the problem of instability at high temperature, as demonstrated by stripping of a plated coating at the temperature of shrinkage fit between the rotor and the shaft. It is difficult to industrially apply the plating surface treatment to large size magnets, yielding many undesirably plated parts.

As discussed above, rare earth permanent magnets for use in high efficiency motors are exposed to the refrigerants and/or lubricants at high temperature and high pressure for an extended period of time and will detract from their magnetic properties due to reaction or corrosion therewith.

SUMMARY OF THE INVENTION

An object of the invention is to provide a method for preparing a rare earth permanent magnet having improved stability, corrosion resistance and hydrogen barrier property under rigorous conditions as discussed above.

In one embodiment, the invention provides a method for preparing a rare earth permanent magnet to be exposed to a refrigerant and/or lubricant for an extended period of time, comprising the steps of casting an alloy based on R, T and B, wherein R is neodymium or a combination of neodymium with one or more rare earth elements, T is iron or a mixture of iron and cobalt, and B is boron, said alloy consisting essentially of 17 to 33.5% by weight of neodymium, 26.8 to 33.5% by weight of the entire R (inclusive of neodymium), 0.78 to 1.25% by weight of B, 0.05 to 3.5% by weight of at least one element selected from the group consisting of Ni, Ga, Zr, Nb, Hf, Ta, Mn, Sn, Mo, Zn, Pb, Sb, Al, Si, V, Cr, Ti, Cu, Ca and Mg, the balance being T and incidental impurities; crushing the alloy in an oxygen-free atmosphere of argon, nitrogen or vacuum, followed by comminution, compacting under a magnetic field, sintering and aging, thereby yielding a sintered magnet having an oxygen concentration of up to 0.8% by weight, and magnetic properties including a residual flux density Br of 12.0 to 15.2 kG and a coercive force iHc of 9 to 35 kOe; cutting and/or polishing the sintered magnet to give a finished surface; and heat treating the sintered magnet in an argon, nitrogen or low-pressure vacuum atmosphere having an oxygen partial pressure of $10^{-6}$ to $10^{0}$ torr for 10 minutes to 10 hours.

Another embodiment provides a method for preparing a rare earth permanent magnet to be exposed to a refrigerant and/or lubricant for an extended period of time, comprising the steps of furnishing a mother alloy based on R, T and B, wherein R is neodymium or a combination of neodymium with one or more rare earth elements, T is iron or a mixture of iron and cobalt, and B is boron, said mother alloy consisting essentially of 17 to 33.5% by weight of neodymium, 26.8 to 33.5% by weight of the entire R (inclusive of neodymium), 0.78 to 1.25% by weight of B, 0.05 to 3.5% by weight of at least one element selected from the group consisting of Ni, Ga, Zr, Nb, Hf, Ta, Mn, Sn, Mo, Zn, Pb, Sb, Al, Si, V, Cr, Ti, Cu, Ca and Mg, the balance being T and incidental impurities, and an auxiliary alloy consisting essentially of 28 to 70% by weight of R' wherein R' is at least one rare earth element, 0 to 1.5% by weight of B, 0.05 to 10% by weight of at least one element selected from the group consisting of Ni, Ga, Zr, Nb, Hf, Ta, Mo, Al, Si, V, Cr, Ti and Cu, the balance being a mixture of iron and cobalt and incidental impurities; hydriding and crushing the mother alloy in an oxygen-free atmosphere of argon, nitrogen or vacuum; mixing 85 to 99% by weight of the crushed mother alloy with 1 to 15% by weight of the auxiliary alloy, followed by comminution, compacting under a magnetic field, sintering and aging, thereby yielding a sintered magnet having an oxygen concentration of up to 0.8% by weight, and magnetic properties including a residual flux density Br of 12.0 to 15.2 kG and a coercive force iHc of 9 to 35 kOe; cutting and/or polishing the magnet to give a finished surface; and heat treating the magnet in an argon, nitrogen or low-pressure vacuum atmosphere having an oxygen partial pressure of $10^{-6}$ to $10^{0}$ torr for 10 minutes to 10 hours.

Regarding a rare earth magnet which is used in various high efficiency motors (complying with the revised energy saving regulation enacted in Japan) and exposed to HFC alternative refrigerant and/or lubricant under operating conditions for an extended period of time, the inventor has found that corrosion resistance is improved by heat treating the magnet, which has been surface finished as mentioned above, in an argon, nitrogen or low-pressure vacuum atmosphere having an oxygen partial pressure of $10^{-6}$ to $10^{0}$ torr, and preferably at a temperature of 200 to 1,100° C., for 10 minutes to 10 hours.

DESCRIPTION OF THE PREFERRED EMBODIMENT

Figure 1:
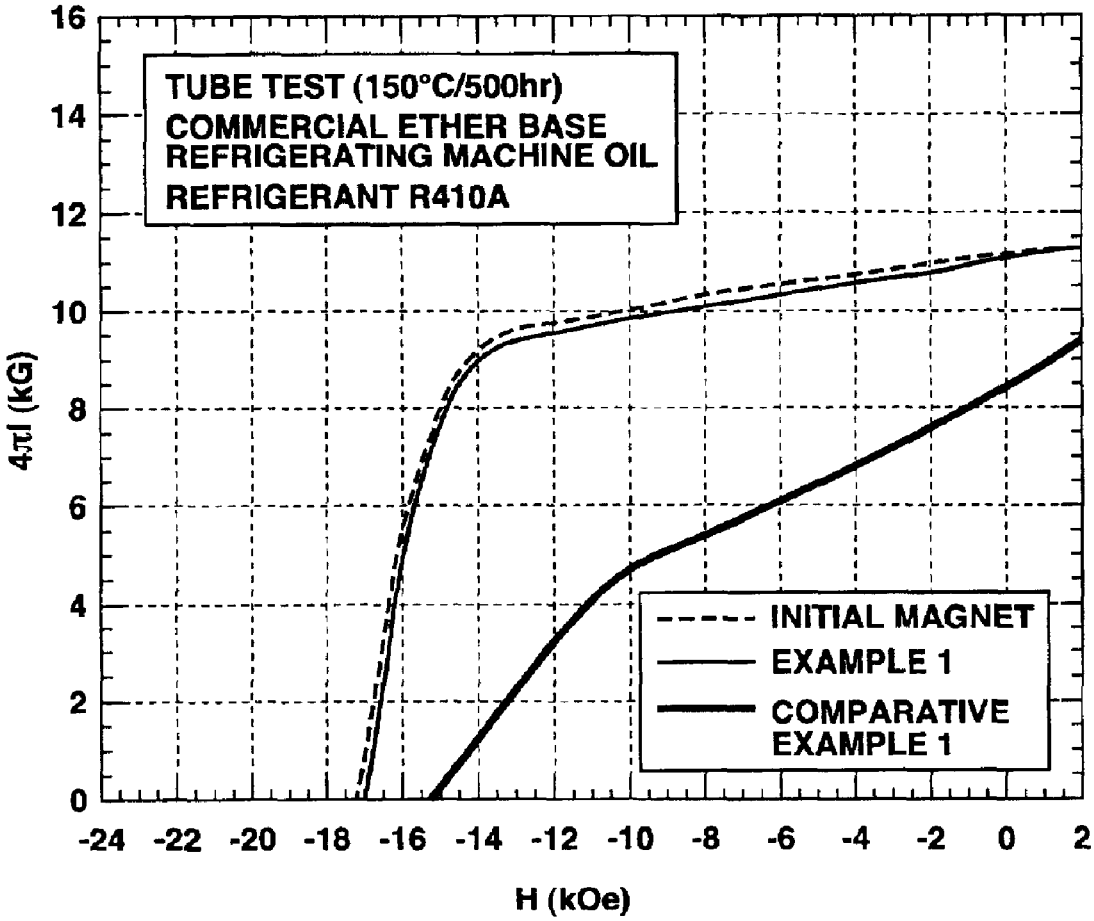
FIG. 1 is a graph showing magnetic properties of R—Fe—B permanent magnet specimens of Example 1 and Comparative Example 1 before and after a 150° C./500 hour tube test using a commercial ether base refrigerating machine oil and refrigerant R410A.

In preparing a rare earth permanent magnet according to the invention, an alloy based on R, T and B is first cast. Herein R is neodymium or a combination of neodymium with one or more rare earth elements, T is iron or a mixture of iron and cobalt, and B is boron. The alloy consists essentially of 17 to 33.5% by weight of neodymium, 26.8 to 33.5% by weight of the entire R (inclusive of neodymium), 0.78 to 1.25% by weight of B, 0.05 to 3.5% by weight of at least one element selected from the group consisting of Ni, Ga, Zr, Nb, Hf, Ta, Mn, Sn, Mo, Zn, Pb, Sb, Al, Si, V, Cr, Ti, Cu, Ca and Mg, the balance being T and incidental impurities.

R in the R—Fe—B permanent magnet accounts for 26.8 to 33.5% by weight of the composition. R is neodymium or a combination of neodymium with another rare earth element which is typically selected from among Y, La, Ce, Pr, Pm, Sm, Gd, Tb, Dy, Ho, Er, Lu, and Yb and mixtures of any. Preferably R is neodymium or a combination of neodymium with at least one of Ce, La, Pr, Dy, and Tb. While R should essentially contains neodymium, the content of neodymium in the alloy is 17 to 33.5% by weight, preferably 17 to 33% by weight. B is contained in the range of 0.78 to 1.25% by weight. T the amount of which is the balance is Fe or Fe and Co. Preferably, Fe is contained in the range of 50 to 70% by weight in the alloy. Partial replacement of iron by cobalt can improve the temperature characteristics. The content of cobalt (Co/(Co+Fe)) is preferably 20% by weight or less, more preferably 0.1 to 15% by weight based on the total weight of iron and cobalt. Inclusion of more than 20% by weight of cobalt may result in a reduced coercive force and an increased cost. For the purposes of improving the magnetic properties and reducing the cost, the alloy further contains one or more elements selected from the group consisting of Ni, Ga, Zr, Nb, Hf, Ta, Mn, Sn, Mo, Zn, Pb, Sb, Al, Si, V, Cr, Ti, Cu, Ca and Mg. The alloy of the above-described composition can be obtained by melting a corresponding material at or above the melting point of the alloy and casting the material by a die casting, roll quenching, or atomizing technique. The preferred casting techniques are die casting and chill roll techniques.

The alloy is crushed in an oxygen-free atmosphere of argon, nitrogen or vacuum, typically by hydriding or using a Brown mill, pin mill, jaw crasher or the like. It is then comminuted, preferably to a mean particle size of about 1 to 30 $\mu$m. The resulting powder is compacted and oriented under a magnetic field or compacted in the absence of a magnetic field. The compact is sintered, solid solution treated and aged to form a bulk body. The bulk body is machined and polished, thereby yielding a permanent magnet of the desired practical shape.

Alternatively, the rare earth magnet is obtained by furnishing a mother alloy based on R, T and B, wherein R is neodymium or a combination of neodymium with one or more rare earth elements, T is iron or a mixture of iron and cobalt, and B is boron, the mother alloy consisting essentially of 17 to 33.5%, especially 17 to 33% by weight of neodymium, 26.8 to 33.5% by weight of the entire R (inclusive of neodymium), 0.78 to 1.25% by weight of B, 0.05 to 3.5% by weight of one or more elements selected from the group consisting of Ni, Ga, Zr, Nb, Hf, Ta, Mn, Sn, Mo, Zn, Pb, Sb, Al, Si, V, Cr, Ti, Cu, Ca and Mg, the balance being T and incidental impurities, and an auxiliary alloy consisting essentially of 28 to 70% by weight of R' wherein R' is a rare earth element or a mixture of two or more rare earth elements, 0 to 1.5% by weight of B, 0.05 to 10% by weight of one or more elements selected from the group consisting of Ni, Ga, Zr, Nb, Hf, Ta, Mo, Al, Si, V, Cr, Ti and Cu, the balance being a mixture of iron and cobalt and incidental impurities, hydriding and crushing the mother alloy in an oxygen-free atmosphere of argon, nitrogen or vacuum, mixing 85 to 99% by weight of the crushed mother alloy with 1 to 15% by weight of the auxiliary alloy and optionally, a lubricating agent, followed by comminution, compacting under a magnetic field, sintering and aging. The magnet may be further cut and/or polished to give a finished surface. The lubricating agent used herein includes higher fatty acids such as oleic acid, stearic acid and lauric acid and salts thereof.

With respect to the auxiliary alloy, R' is one or more elements selected from among Y, La, Ce, Pr, Nd, Pm, Sm, Gd, Tb, Dy, Ho, Er, Lu and Yb, and preferably one or more elements selected from among Ce, La, Nd, Pr, Dy and Tb. The preferred content of B is 0.78 to 1.25% by weight. The preferred content of cobalt is 10 to 60%, especially 10 to 40% by weight based on the auxiliary alloy, preferably with iron making up the balance.

The permanent magnet (sintered magnet) thus obtained in either embodiment should have an oxygen concentration of up to 0.8% by weight, and magnetic properties including a residual flux density Br of 12.0 kG to 15.2 kG and a coercive force iHc of 9 kOe to 35 kOe. It is preferred for improved magnetic properties including coercivity that the sintered magnet have an oxygen concentration of 0.05 to 0.8% by weight and a carbon concentration of 0.03 to 0.10% by weight.

According to the invention, the permanent magnet is then heat treated for thereby improving corrosion resistance. The heat treatment is preferably at a temperature of 200 to 1,100° C., more preferably 300 to 600° C., and even more preferably 450 to 550° C. Too high a heat treatment temperature may deteriorate magnetic properties whereas too low a heat treatment temperature may fail to improve the durability against lubricants and/or refrigerants.

The atmosphere of heat treatment is an argon, nitrogen or low-pressure vacuum atmosphere having an oxygen partial pressure of $10^{-6}$ to $10^{0}$ torr, preferably $10^{-5}$ to $10^{-4}$ torr. The duration of heat treatment is from 10 minutes to 10 hours, preferably from 10 minutes to 6 hours and more preferably from 30 minutes to 3 hours. Following heat treatment at the desired temperature in the prescribed atmosphere, the R—Fe—B permanent magnet may be cooled at a rate of 10 to 2,000° C./min. If desired, heat treatment may be effected in plural stages.

The heat treatment forms suboxides on the magnet surface, thereby yielding a highly corrosion resistant rare earth permanent magnet suitable for use in high efficiency motors. The magnet obtained by the invention is characterized by exhibiting corrosion resistance to HFC alternative refrigerants (e.g., R410A, R134a and R125), HCFC refrigerants (e.g., R22 and R32) and lubricants (e.g., refrigerating machine oil such as mineral oil, ester oil or ether oil).

EXAMPLE

Examples of the invention are given below by way of illustration and not by way of limitation.

Example 1

After induction melting in an argon atmosphere, an ingot having the composition of 32Nd-1.2B-59.8Fe-7Co in weight ratio was cast. The ingot was crushed by a jaw crusher and comminuted by a jet mill using nitrogen gas, obtaining particles having a mean particle size of 3.5 $\mu$m. The powder was placed in a mold and compacted therein under a pressure of 1.0 ton/cm$^2$ while a magnetic field of 10 kOe was applied across the mold. The compact was sintered in vacuum at 1,100° C. for two hours and aged at 550° C. for one hour, obtaining a permanent magnet. From the permanent magnet, a magnet plate dimensioned 5.9 mm×5.9 mm×1.2 mm thick was cut out. The magnet plate had an oxygen concentration of 0.611 wt %, Br=11.28 kG and iHc=17.20 kOe. Barrel finishing and ultrasonic water washing were carried out on the magnet plate. Using a vacuum heat treating apparatus filled with argon gas having an oxygen partial pressure of $10^{-5}$ torr, the magnet plate was heat treated at 490° C. for one hour. This was used as a test specimen.

In a cap bolt type pressure vessel having a volume of 200 ml (TPR N2 type by Taiatsu Glass Kogyo K. K.), 20 g of a commercially available ester base refrigerating machine oil or ether base refrigerating machine oil was weighed, and the specimen of R—Fe—B permanent magnet was placed. After the pressure vessel was closed, it was cooled with a dry ice/ethanol freezing mixture. HFC alternative in the liquid state as the refrigerant was injected into the vessel. The amount of HFC alternative introduced was determined from the weight gain of the overall pressure vessel. The HFC alternative feed was controlled so as to give a HFC alternative weight of 20 g, that is, to set the weight ratio of refrigerant to refrigerating machine oil at 1:1. This is a conventional procedure of evaluating the corrosion resistance in a compressor, generally known as tube test. The pressure vessel was placed in a thermostat tank set at 150±0.5° C. and heated therein for a predetermined time (500 or 1,000 hours). Thereafter, the pressure vessel was opened, and the R—Fe—B magnet was taken out and examined for magnetic properties as well as changes thereof from the initial. The results are shown in FIG. 1. Table 1 reports changes of magnetic properties (represented by a percent deterioration at Pc=0 of magnet properties after the test from magnet properties prior to the test).

Comparative Example 1

An R—Fe—B permanent magnet was prepared as in Example 1 except that the heat treatment was omitted. Using this magnet as a test specimen, a similar tube test was carried out. The results are shown in FIG. 1 and Table 1.

Comparative Example 2

Figure 2:
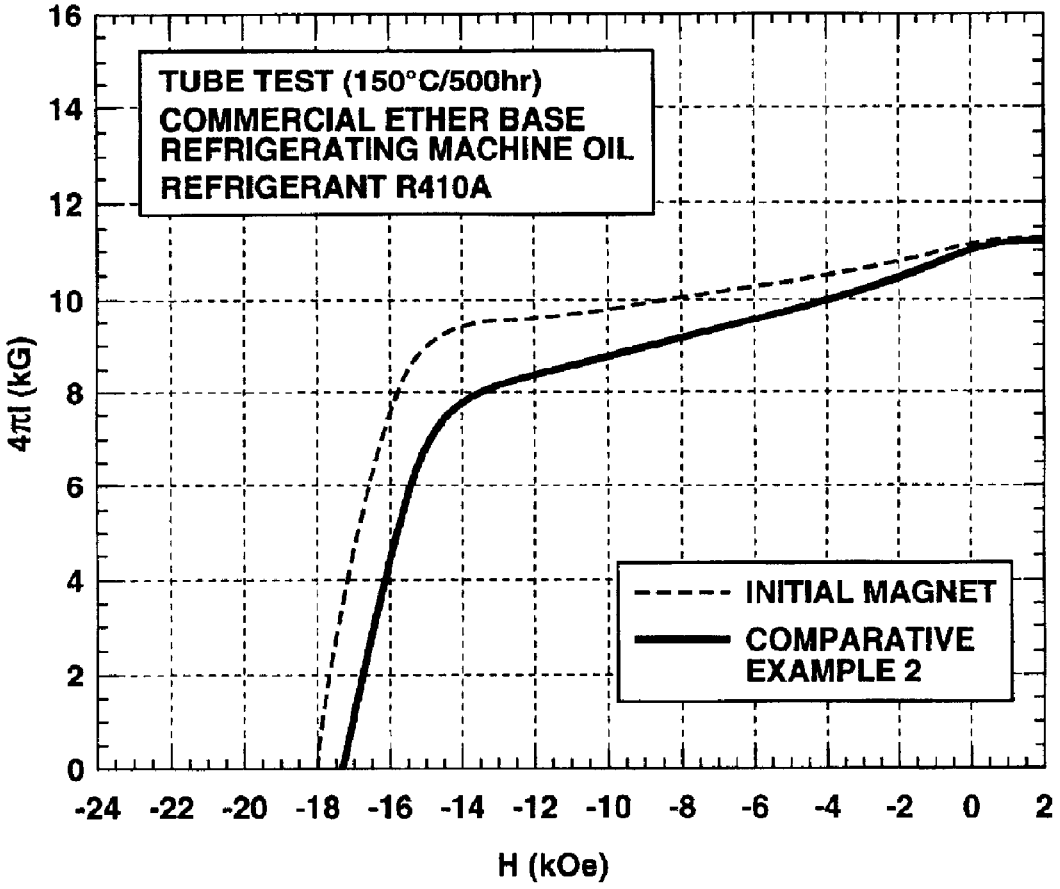
FIG. 2 is a graph showing magnetic properties of the R—Fe—B permanent magnet specimen of Comparative Example 2 before and after the tube test.

An R—Fe—B permanent magnet was prepared as in Example 1 except that the heat treatment was effected in air at 400° C. for 30 minutes. Using this magnet as a test specimen, a similar tube test was carried out. The results are shown in FIG. 2 and Table 1.

It is noted that the magnet specimens after the tube test had the following magnetic properties.

| | Br | 1Hc |
|---|---|---|
| Example 1 | 11.13 kG | 16.96 kOe |
| Comparative Example 1 | 8.50 kG | 14.99 kOe |
| Comparative Example 2 | 10.98 kG | 17.36 kOe |

TABLE 1

| Commercial refrigerating machine oil | HFC Alternative | Deterioration* after tube test (150° C.) CE1 500 hr | CE1 1000 hr | EX1 500 hr | EX1 1000 hr | CE2 500 hr |
|---|---|---|---|---|---|---|
| ester oil | R410A | 12.0% | 31.8% | 1.1% | 1.2% | 1.60% |
| ether oil | R410A | 31.9% | unmeasurable (powdered) | 1.2% | 1.5% | 8.90% |

*a percent deterioration at Pc = 0 of magnet property after the tube test from the initial magnet property.

It is seen from Table 1 that the R—Fe—B permanent magnet without the heat treatment, when combined with the ether base refrigerating machine oil, experienced a substantial deterioration of magnetic property after 500 hours of the tube test and became powdered after 1,000 hours of the tube test so that magnet fragments were dispersed in the refrigerating machine oil. In an actual compressor wherein a miscible fluid of refrigerant and refrigerating machine oil is being circulated under high pressure through piping of high strength copper, the generation of such sludge causes the piping to be clogged, becoming a fatal defect. As is evident from Table 1, by heat treatment, the magnet is endowed with practically acceptable corrosion resistance even in a high pressure with hot environment. However, heat treatment when conducted in air rather degrades magnetic properties as seen from Comparative Example 2.

Example 2

The samples of this example are low oxygen concentration alloys prepared by conducting crushing to sintering steps in an oxygen-blocked atmosphere. The starting materials Nd, Pr, Dy, Tb, electrolytic iron, Co, ferroboron, Al, Cu and optionally ferrozirconium or ferrohafnium were formulated to the composition shown in Table 2, following which the respective alloys were prepared by a double roll quenching process. The alloys were hydrogenated in a 1.5±0.5 kgf/cm$^2$ hydrogen atmosphere, followed by dehydrogenation at 600° C. for 5 hours in a $\leqq 10^{-2}$ torr vacuum. Each of the alloys obtained following hydrogenation and dehydrogenation was in the form of a coarse powder having a particle size of several hundred microns. The coarse powders were each mixed with 0.06 wt % of lauric acid as a lubricating agent in a V-type mixer, and comminuted to a mean particle size of about 3 $\mu$m under a nitrogen stream in a jet mill. The resulting fine powders were filled into the die of a press, oriented in a 13 kOe magnetic field, and compacted under a pressure of 1.2 ton/cm$^2$ applied perpendicular to the magnetic field. The powder compacts were sintered at 1,050° C. for 2 hours in argon, cooled, and heat treated at 500° C. for 2 hours in argon, yielding permanent magnet materials of the respective compositions. These R—Fe—B base permanent magnet materials had a carbon content of 0.061 to 0.073 wt % and an oxygen content of 0.105 to 0.186 wt %. Their magnetic properties are shown in Table 2.

TABLE 2

| Sample | Components (wt %) | | | | | | | | | | | Br | iHc |
|---|---|---|---|---|---|---|---|---|---|---|---|---|---|
| No. | Nd | Pr | Dy | Tb | Fe | Co | B | Al | Cu | Zr | Hf | (kG) | (kOe) |
| 1 | 30.2 | 0.0 | 0.0 | 0.0 | bal. | 2.7 | 1.1 | 0.4 | 0.2 | 0.0 | 0.0 | 14.23 | 9.2 |
| 2 | 27.6 | 0.0 | 3.7 | 0.0 | bal. | 1.4 | 1.1 | 0.2 | 0.1 | 0.0 | 0.0 | 13.35 | 18.8 |
| 3 | 27.7 | 0.0 | 0.0 | 2.4 | bal. | 1.4 | 1.0 | 0.2 | 0.1 | 0.2 | 0.0 | 13.86 | 13.2 |
| 4 | 26.3 | 0.0 | 4.9 | 0.0 | bal. | 1.8 | 1.0 | 0.3 | 0.1 | 0.0 | 0.3 | 13.22 | 15.3 |

Example 3

The starting materials Nd, Dy, electrolytic iron, Co, ferroboron, Al, and Cu were formulated to the composition shown in Table 3, following which the formulations were induction melted and cast in a water-cooled copper mold to give ingots of the respective compositions. The cast ingots were roughly ground in a Brown mill. The resulting coarse powders were each mixed with 0.08 wt % of stearic acid as a lubricating agent in a V-type mixer, and comminuted to a mean particle size of about 3 $\mu$m under a nitrogen stream in a jet mill. The resulting fine powders were filled into the die of a press, oriented in a 12 kOe magnetic field, and compacted under a pressure of 1.5 ton/cm$^2$ applied perpendicular to the magnetic field. The powder compacts were sintered at 1,080° C. for 2 hours in a $\leqq 10^{-3}$ torr vacuum, cooled, and heat treated at 600° C. for 1 hour in a $\leqq 10^{-2}$ torr vacuum, yielding permanent magnet materials of the respective compositions. These R—Fe—B base permanent magnet materials had a carbon content of 0.081 to 0.092 wt % and an oxygen content of 0.058 to 0.071 wt %. Their magnetic properties are shown in Table 3.

TABLE 3

| Sample | Components (wt %) | | | | | | | | | | | Br | iHc |
|---|---|---|---|---|---|---|---|---|---|---|---|---|---|
| No. | Nd | Pr | Dy | Tb | Fe | Co | B | Al | Cu | Zr | Hf | (kG) | (kOe) |
| 5 | 32.8 | 0.0 | 0.0 | 0.0 | bal. | 4.4 | 1.0 | 0.8 | 0.3 | 0.0 | 0.0 | 12.62 | 12.5 |
| 6 | 26.3 | 2.1 | 2.5 | 2.4 | bal. | 3.6 | 1.1 | 0.8 | 0.2 | 0.0 | 0.0 | 12.18 | 21.5 |

Example 4

This example attempted to achieve even higher magnetic properties by applying a two alloy process to the invention. The samples of this example are low oxygen concentration alloys prepared by conducting crushing to sintering steps in an oxygen-blocked atmosphere. With respect to the experimental conditions, only the compositions of the mother alloy and the auxiliary alloy were varied as shown in Table 4. The mother alloy was fabricated by single roll quenching, hydrogenated in a hydrogen atmosphere at 0.5 to 2.0 kgf/cm$^2$, then semi-dehydrogenated in a $\leqq 10^{-2}$ torr vacuum and at 500° C. for 5 hours. The auxiliary alloy was induction melted, then cast in a water-cooled copper mold, giving a cast ingot.

Next, 90 wt % of the mother alloy and 10 wt % of the auxiliary alloy were weighed out, 0.05 wt % of oleic acid was added as a lubricating agent, and they were mixed in a V-type mixer. The mixture was then comminuted in a jet mill under a nitrogen stream, giving a fine powder having a mean particle size of about 4 $\mu$m. The resulting powders were filled into the die of a press, oriented in a 12 kOe magnetic field, and compacted under a pressure of 0.5 ton/cm$^2$ applied in a direction perpendicular to the magnetic field. The powder compacts were sintered at 1,040° C. for 2 hours under a vacuum of $\leqq 10^{-4}$ torr, cooled, then heat treated at 500° C. for 1 hour in an argon atmosphere, yielding permanent magnet materials of the respective compositions. These R—Fe—B base permanent magnet materials had a carbon content of 0.052 to 0.063 wt % and an oxygen content of 0.085 to 0.105 wt %. Their magnetic properties are shown in Table 4.

TABLE 4

| | Components (wt %) | | | | | | | | | | | | |
|---|---|---|---|---|---|---|---|---|---|---|---|---|---|
| Sample No. | Nd | Pr | Dy | Tb | Fe | Co | B | Al | Cu | Zr | Hf | Br (kG) | iHc (kOe) |
| 7 | | | | | | | | | | | | | |
| Mother | 27.6 | 0.0 | 0.0 | 0.0 | bal. | 0.9 | 1.0 | 0.4 | 0.0 | 0.0 | 0.0 | 14.45 | 16.3 |
| Auxiliary | 35.0 | 0.0 | 19.7 | 0.0 | 13.6 | bal. | 0.8 | 0.7 | 1.5 | 0.0 | 0.0 | | |
| Total | 28.0 | 0.0 | 2.0 | 0.0 | bal. | 3.7 | 1.0 | 0.4 | 0.2 | 0.0 | 0.0 | | |
| 8 | | | | | | | | | | | | | |
| Mother | 27.3 | 0.0 | 0.0 | 0.0 | bal. | 0.5 | 1.0 | 0.4 | 0.0 | 0.0 | 0.0 | 14.89 | 11.3 |
| Auxiliary | 37.0 | 0.0 | 10.4 | 0.0 | 17.9 | bal. | 0.8 | 0.3 | 0.8 | 0.0 | 0.0 | | |
| Total | 28.2 | 0.0 | 1.0 | 0.0 | bal. | 3.4 | 1.0 | 0.4 | 0.1 | 0.0 | 0.0 | | |

TABLE 4-continued

| Sample No. | Components (wt %) | | | | | | | | | | | Br (kG) | iHc (kOe) |
|---|---|---|---|---|---|---|---|---|---|---|---|---|---|
| | Nd | Pr | Dy | Tb | Fe | Co | B | Al | Cu | Zr | Hf | | |
| 9 | | | | | | | | | | | | | |
| Mother | 27.3 | 0.0 | 0.0 | 0.0 | bal. | 0.2 | 1.0 | 0.4 | 0.0 | 0.0 | 0.0 | 15.11 | 9.8 |
| Auxiliary | 36.2 | 0.0 | 0.0 | 10.2 | 17.5 | bal. | 0.8 | 0.3 | 0.8 | 0.0 | 4.5 | | |
| Total | 28.2 | 0.0 | 1.0 | 0.0 | bal. | 3.1 | 1.0 | 0.4 | 0.1 | 0.0 | 0.4 | | |

Example 5

This example attempted to achieve even higher magnetic properties by applying a two alloy process to the invention. The compositions of the mother alloy and the auxiliary alloy were varied as shown in Table 5. Both the mother alloy and the auxiliary alloy were induction melted, then cast in a water-cooled copper mold, giving cast ingots.

Next, 92 wt % of the mother alloy and 8 wt % of the auxiliary alloy were weighed out, 0.05 wt % of zinc stearate was added as a lubricating agent, and they were mixed in a V-type mixer. The mixture was then comminuted in a jet mill under a nitrogen stream, giving a fine powder having a mean particle size of about 4 $\mu$m. The resulting powders were filled into the die of a press, oriented in a 12 kOe magnetic field, and compacted under a pressure of 0.5 ton/cm$^2$ applied in a direction perpendicular to the magnetic field. The powder compacts were sintered at temperatures ranging from 1,020° C. to 1,100° C. in 10° C. increments for 2 hours under a vacuum of $\leqq 10^{-4}$ torr, cooled, then heat treated at 500° C. for 1 hour in an argon atmosphere of $\leqq 10^{-2}$ torr, yielding permanent magnet materials of the respective compositions. These R–Fe–B base permanent magnet materials had a carbon content of 0.063 to 0.075 wt % and an oxygen content of 0.328 to 0.457 wt %. Their magnetic properties are shown in Table 5.

Example 6

This example attempted to achieve even higher magnetic properties by applying a two alloy process to the invention. The compositions of the mother alloy and the auxiliary alloy were varied as shown in Table 6. Both the mother alloy and the auxiliary alloy were fabricated by single roll quenching, hydrogenated in a hydrogen atmosphere at 0.5 to 2.0 kgf/cm$^2$, then semi-dehydrogenated in a $\leqq 10^{-2}$ torr vacuum and at 500° C. for 3 hours.

Next, 94 wt % of the mother alloy and 6 wt % of the auxiliary alloy were weighed out, 0.05 wt % of zinc stearate was added as a lubricating agent, and they were mixed in a V-type mixer. The mixture was then comminuted in a jet mill under a nitrogen stream, giving a fine powder having a mean particle size of about 4 $\mu$m. The resulting powders were filled into the die of a press, oriented in a 12 kOe magnetic field, and compacted under a pressure of 0.5 ton/cm$^2$ applied in a direction perpendicular to the magnetic field. The powder compacts were sintered at temperatures ranging from 1,020° C. to 1,100° C. in 10° C. increments for 2 hours under a $\leqq 10^{-4}$ torr vacuum, cooled, then heat treated at 500° C. for 1 hour under a $\leqq 10^{-2}$ torr vacuum, yielding permanent magnet materials of the respective compositions. These R—Fe—B base permanent magnet materials had a carbon content of 0.082 to 0.093 wt % and an oxygen content of 0.115 to 0.205 wt %. Their magnetic properties are shown in Table 6.

TABLE 5

| Sample No. | Components (wt %) | | | | | | | | | | | Br (kG) | iHc (kOe) |
|---|---|---|---|---|---|---|---|---|---|---|---|---|---|
| | Nd | Pr | Dy | Tb | Fe | Co | B | Al | Cu | Zr | Hf | | |
| 10 | | | | | | | | | | | | | |
| Mother | 28.2 | 0.0 | 0.0 | 0.5 | bal. | 0.5 | 1.2 | 0.8 | 0.0 | 0.0 | 0.0 | 13.45 | 24.0 |
| Auxiliary | 25.2 | 0.0 | 28.4 | 0.0 | bal. | 20.6 | 0.0 | 0.3 | 2.2 | 0.0 | 0.0 | | |
| Total | 28.0 | 0.0 | 3.4 | 0.5 | bal. | 2.1 | 1.1 | 0.8 | 0.2 | 0.0 | 0.0 | | |
| 11 | | | | | | | | | | | | | |
| Mother | 26.9 | 2.2 | 1.3 | 0.0 | bal. | 0.5 | 1.2 | 0.4 | 0.0 | 0.0 | 0.0 | 12.80 | 22.8 |
| Auxiliary | 25.0 | 0.0 | 28.2 | 0.0 | 10.3 | bal. | 0.0 | 0.3 | 2.2 | 0.0 | 0.0 | | |
| Total | 26.7 | 2.0 | 3.4 | 0.0 | bal. | 3.1 | 1.1 | 0.1 | 0.2 | 0.0 | 0.0 | | |
| 12 | | | | | | | | | | | | | |
| Mother | 26.6 | 1.0 | 0.0 | 0.0 | bal. | 1.8 | 1.2 | 0.4 | 0.5 | 0.0 | 0.0 | 13.12 | 17.5 |
| Auxiliary | 26.0 | 25.4 | 0.0 | 0.0 | 12.4 | bal. | 0.0 | 0.3 | 0.0 | 0.0 | 0.0 | | |
| Total | 26.6 | 4.0 | 2.3 | 0.0 | bal. | 4.5 | 1.1 | 0.4 | 0.5 | 0.0 | 0.0 | | |

TABLE 6

| Sample No. | Components (wt %) | | | | | | | | | | | Br (kG) | iHc (kOe) |
|---|---|---|---|---|---|---|---|---|---|---|---|---|---|
| | Nd | Pr | Dy | Tb | Fe | Co | B | Al | Cu | Zr | Hf | | |
| 13 | | | | | | | | | | | | | |
| Mother | 29.0 | 0.0 | 0.0 | 0.0 | bal. | 1.8 | 1.0 | 0.2 | 0.0 | 0.0 | 0.0 | 14.55 | 13.8 |
| Auxiliary | 34.4 | 0.0 | 19.4 | 3.8 | bal. | 21.1 | 0.8 | 1.0 | 2.3 | 0.0 | 0.0 | | |
| Total | 29.4 | 0.0 | 1.2 | 0.2 | bal. | 3.0 | 1.0 | 0.3 | 0.1 | 0.0 | 0.0 | | |
| 14 | | | | | | | | | | | | | |
| Mother | 29.2 | 0.0 | 0.0 | 0.0 | bal. | 1.8 | 1.0 | 0.8 | 0.0 | 0.0 | 0.0 | 14.32 | 15.2 |
| Auxiliary | 35.5 | 8.7 | 10.0 | 0.0 | bal. | 14.5 | 0.8 | 0.7 | 1.6 | 2.2 | 0.0 | | |
| Total | 29.6 | 0.5 | 0.6 | 0.0 | bal. | 2.6 | 1.0 | 0.8 | 0.1 | 0.1 | 0.0 | | |
| 15 | | | | | | | | | | | | | |
| Mother | 29.3 | 0.0 | 0.0 | 0.0 | bal. | 0.5 | 1.0 | 0.8 | 0.0 | 0.0 | 0.0 | 13.71 | 14.5 |
| Auxiliary | 27.5 | 9.0 | 10.3 | 0.0 | bal. | 15.0 | 0.8 | 0.7 | 1.6 | 4.5 | 0.0 | | |
| Total | 29.2 | 0.5 | 0.6 | 0.0 | bal. | 1.3 | 1.0 | 0.8 | 0.1 | 0.0 | 0.3 | | |

It is understood that the invention is advantageously applicable to any permanent magnet sample independent of whether the auxiliary alloy was fabricated by induction melting, casting in a water-cooled mold, hydrogenation and semi-dehydrogenation, or by single or double chill roll quenching, hydrogenation and semi-dehydrogenation, or by single or double roll quenching and crushing in a Brown mill or the like.

According to the invention, an R—Fe—B permanent magnet as appropriately processed is further heat treated to form a protective film on the surface whereby a highly oil resistant sintered permanent magnet having corrosion resistance and hydrogen barrier property even in a high pressure with hot environment of refrigerant and lubricant can be readily manufactured at a low cost. The invention is of great worth in the industry.

Japanese Patent Application No. 2000-162301 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A method for preparing a rare earth permanent magnet to be exposed to a refrigerant and/or lubricant for an extended period of time, comprising the steps of:

casting an alloy based on R, T and B, wherein R is neodymium or a combination of neodymium with one or more rare earth elements, T is iron or a mixture of iron and cobalt, and B is boron, said alloy consisting essentially of 17 to 33.5% by weight of neodymium, 26.8 to 33.5% by weight of the entire R, 0.78 to 1.25% by weight of B, 0.05 to 3.5% by weight of at least one element selected from the group consisting of Ni, Ga, Zr, Nb, Hf, Ta, Mn, Sn, Mo, Zn, Pb, Sb, Al, Si, V, Cr, Ti, Cu, Ca and Mg, the balance being T and incidental impurities, crushing the alloy in an oxygen-free atmosphere of argon, nitrogen or vacuum, followed by comminution, compacting under a magnetic field, sintering and aging, thereby yielding a sintered magnet having an oxygen concentration of up to 0.8% by weight, and magnetic properties including a residual flux density Br of 12.0 to 15.2 kG and a coercive fame iHc of 9 to 35 kOe, cutting and/or polishing the sintered magnet to give a sintered magnet with a finished surface, and heat treating the sintered magnet with a finished surface in an argon, nitrogen or low-pressure vacuum atmosphere having an oxygen partial pressure of $10^{-6}$ to $10^{0}$ torr for 10 minutes to 10 hours at a temperature of 200 to 1,100° C.

2. A method for preparing a rare earth permanent magnet to be exposed to a refrigerant and/or lubricant for an extended period of time, comprising the steps of:

furnishing a mother alloy based on R, T and B, wherein R is neodymium or a combination of neodymium with one or more rare earth elements, T is iron or a mixture of iron and cobalt, and B is boron, said mother alloy consisting essentially of 17 to 33.5% by weight of neodymium, 26.8 to 33.5% by weight of the entire R, 0.78 to 1.25% by weight of B, 0.05 to 3.5% by weight of at least one element selected from the group consisting of Ni, Ga, Zr, Nb, Hf, Ta, Mn, Sn, Mo, Zn, Pb, Sb, Al, Si, V, Cr, Ti, Cu, Ca and Mg, the balance being T and incidental impurities, and an auxiliary alloy consisting essentially of 28 to 70% by weight of R' wherein R' is at least one rare earth element, 0 to 1.5% by weight of B, 0.05 to 10% by weight of at least one element selected from the group consisting of Ni, Ga, Zr, Nb, Hf, Ta, Mo, Al, Si, V, Cr, Ti and Cu, the balance being a mixture of iron and cobalt and incidental impurities, hydriding and crushing the mother alloy in an oxygen-free atmosphere of argon, nitrogen or vacuum, mixing 85 to 99% by weight of the crushed mother alloy with 1 to 15% by weight of the auxiliary alloy, followed by comrninution, compacting under a magnetic field, sintering and aging, thereby yielding a sintered magnet having an oxygen concentration of up to 0.8% by weight, and magnetic properties including a residual flux density Br of 12.0 to 15.2 kG and a coercive force iHc of 9 to 35 kOe, cutting and/or polishing the magnet to give a sintered magnet with a finished surface, and heat treating the sintered magnet with a finished surface in an argon, nitrogen or low-pressure vacuum atmosphere having an oxygen partial pressure of $10^{-6}$ to $10^{0}$ torr for 10 minutes to 10 hours at a temperature of 200 to 1,100° C.

3. The method of claim 1 wherein the sintered magnet has an oxygen concentration of 0.05 to 0.8% by weight and a carbon concentration of 0.03 to 0.10% by weight.

4. The method of claim 2 wherein the sintered magnet has an oxygen concentration of 0.05 to 0.8% by weight and a carbon concentration of 0.03 to 0.10% by weight.

5. The method of claim 1 wherein the heat treatment is effected at a temperature of 300 to 600° C.

6. The method of claim 2 wherein the heat treatment is effected at a temperature of 300 to 600° C.

7. The method of claim 1, wherein the content of cobalt in T, if present, is 20% by weight or less based on the total weight of iron and cobalt.

8. The method of claim 2, wherein the content of cobalt in T, if present, is 20% by weight or less based on the total weight of iron and cobalt.

9. The method of claim 1, wherein the comminution is to a mean particle size of about 1 to 30 $\mu$m.

10. The method of claim 2, wherein the comminution is to a mean particle size of about 1 to 30 $\mu$m.

11. The method of claim 1, wherein the heat treating is conducted in an argon or nitrogen atmosphere having an oxygen partial pressure of $10^{-6}$ to $10^{0}$ torr.

12. The method of claim 2, wherein the heat treating is conducted in an argon or nitrogen atmosphere having an oxygen partial pressure of $10^{-6}$ to $10^{0}$ torr.

* * * * *